US005358610A

United States Patent [19]

Kawasumi et al.

[11] Patent Number: 5,358,610

[45] Date of Patent: Oct. 25, 1994

[54] METHOD FOR ELECTROLYTIC TREATMENT

[75] Inventors: Seiji Kawasumi; Akio Uesugi, both of Shizuoka, Japan

[73] Assignee: Fuji Photo Film Co., Ltd., Minami-ashigara, Japan

[21] Appl. No.: 92,901

[22] Filed: Jul. 19, 1993

[30] Foreign Application Priority Data

Jul. 20, 1992 [JP] Japan ..... 4-191778
Jul. 22, 1992 [JP] Japan ..... 4-195006

[51] Int. Cl.[5] ..... C25F 3/04

[52] U.S. Cl. ..... 204/129.4; 204/129.43; 204/140

[58] Field of Search ..... 204/129.4, 129.43, 140

[56] References Cited

U.S. PATENT DOCUMENTS 4,897,168 1/1990 Boergerding et al. ..... 204/129.43
4,919,774 4/1990 Minato et al. ..... 204/129.43 X
5,082,537 1/1992 Stroszynski et al. ..... 204/129.4 X
5,152,877 10/1992 Nishino et al. ..... 204/129.4

FOREIGN PATENT DOCUMENTS 390033 10/1990 European Pat. Off. .
3828291 3/1989 Fed. Rep. of Germany .

*Primary Examiner*—Donald R. Valentine
*Attorney, Agent, or Firm*—Burns, Doane, Swecker & Mathis

[57] ABSTRACT

A method for electrolytic treatment comprising forming electrochemically a rough surface on a material to be treated by supplying alternating current between the material to be treated and electrodes in an electrolytic solution containing metal ions, wherein when y[m/min.] indicates a travelling speed of the material, f[Hz] indicates line frequency and x[cm] indicates a distance between leading ends of the electrodes, an electrolytic roughening treatment is conducted by selecting x, y and f so as to satisfy the following formula;

$$0 \leqq g\left(\frac{60 \cdot x \cdot f}{100 \cdot z}\right) \leqq 0.2$$

or $$0.8 \leqq g\left(\frac{60 \cdot x \cdot f}{100 \cdot z}\right) < 1$$

(in the formula, g(a)=a−[a], here [a] indicates a maximum integer which does not exceed a.)

4 Claims, 2 Drawing Sheets

METHOD FOR ELECTROLYTIC TREATMENT

BACKGROUND OF THE INVENTION

This invention relates to a method for electrolytic treatment which electrochemically roughens the surface of an aluminum web for the support used for a presensitized printing plate and the like.

Generally, an aluminum web is utilized as the support for a presensitized printing plate and the surface thereof is usually roughened in order to improve adherence between the aluminum web and the photosensitive layer provided thereon and to retain water utilized at printing.

Conventionally, there was a process as disclosed in U.S. Pat. No. 5,082,537 (corresponding to Japanese Patent KOKAI No. 2-298300) as the roughening process. In the process for roughening, a substrate is conveyed through an aqueous electrolytic bath having a plurality of electrodes and a three-phase or alternating current is applied to the electrodes, wherein the frequency of said three-phase or alternating current is higher than a line frequency of 50 Hz to 60 Hz preferably between about 50 to 300 Hz and the frequency is selected at a value that is related directly to the rate of conveyance of the substrate through the electrolytic bath.

However, in the above mentioned process disclosed in U.S. Pat. No. 5,082,537, a uniformly roughened surface can not be necessarily obtained. That is, since a degree of so-called electrical cross-strokes (a nonuniformity generated in accordance with alternative currents and movement of a material to be treated, when an electrolytic roughening treatment is conducted by supplying alternating current at a very high working speed) is decided by the travelling speed and the frequency of a source, when the line speed is changed, the frequency of a source should be changed according to the change of the line speed in order to obtain the same cross strokes. However, since the degree of a roughened surface is changed according to change of the frequency, a uniformly roughened surface cannot be obtained.

Besides, in the above mentioned conventional method, the contrast of a cross stroke is high and conspicuous.

Moreover, in the above mentioned electrolytic treatment using an alternating electrolysis, there are two ways to increase the amount of electrolytic treatment, i.e. one is a method of increasing the length of electrolytic treatment and the other is a method of increasing current density in the former method, it is necessary to provide not less than two electrolytic treatment baths, and consequently, electric sources are provided respectively for each electrolytic treatment bath.

However, in the above mentioned method for electrolytic treatment, cross-strokes significantly varied periodically.

SUMMARY OF THE INVENTION

An object of the invention is to solve the above mentioned problem and to provide a method for electrolytic treatment wherein a uniform roughened surface is obtained and cross-strokes are not conspicuous.

The inventors earnestly studied to achieve the above mentioned object and found that the cross stroke is determined by the travelling speed, the source frequency and the distance between the end part of the electrodes and completed the invention.

Thus, the present invention provides as the first aspect, a method for electrolytic treatment comprising forming electrochemically a rough surface on a material to be treated by supplying alternating current between the material to be treated and the electrodes in an electrolytic solution containing metal ion, when y[m/min.] indicates a travelling speed of the material, f[Hz] indicates line frequency of a power source and x[cm] indicates a distance between leading end parts of the electrodes, a electrolytic roughening treatment being conducted by selecting x, y and f so as to satisfy the following formula;

$$0 \leqq g\left(\frac{60 \cdot x \cdot f}{100 \cdot y}\right) \leqq 0.2$$

or $$0.8 \leqq g\left(\frac{60 \cdot x \cdot f}{100 \cdot y}\right) < 1$$

(in the formula, $g(a)=a-[a]$, [a] indicates a maximum integer which does not exceed a.)

Another object of the invention is to solve the above mentioned problem and to provide an method for electrolytic treatment wherein cross-strokes do not significantly vary periodically.

The inventors ernestly studied in order to achieve the above mentioned object and found that the periodical variation of appearance of cross-strokes is due to not synchronizing of electric currents supplied by power sources and completed the invention.

Thus, the present invention also provides, as the second aspect, a method for electrolytic treatment comprising forming electrochemically a rough surface on a material to be treated by supplying alternating current between the material to be treated and the electrodes in an electrolytic solution containing metal ions, in case of using two or more of electrolytic treatment baths, the alternating currents supplied to each electrolytic treatment bath are synchronized.

Figure 1:
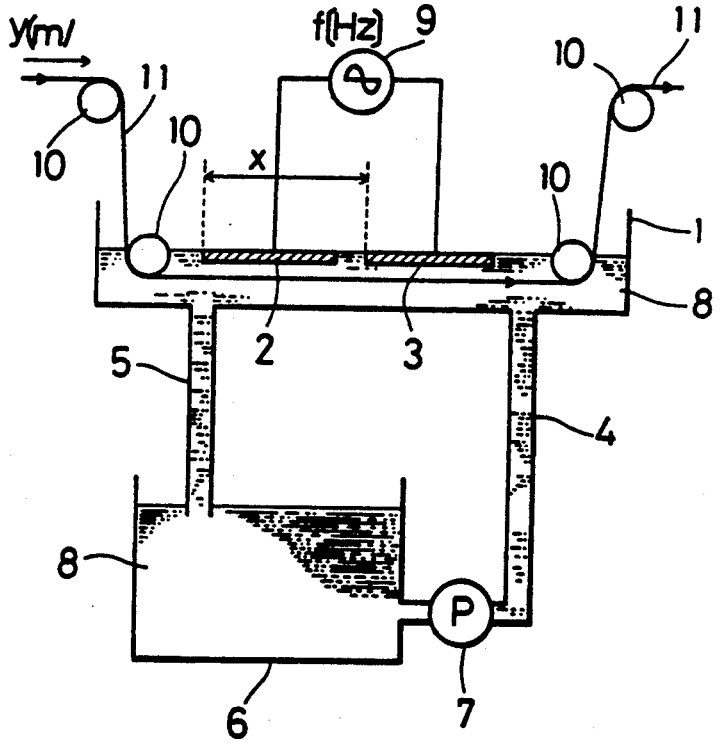
FIG. 1 is a schematic side view illustrating an apparatus to be used for an embodiment of the method for electrolytic treatment of the first aspect of the invention.

1,21,41,51: Electrolytic treatment bath
2,3,22,23,42,43,52,53: Electrode
8,29,48,58: Electrolytic solution
9,24,60,92: Power source
11,32,80: Aluminum web (Material to be treated)

93: Frequency generator
94: Phase difference setting apparatus

DETAILED DESCRIPTION OF THE INVENTION

In the method of the invention when the above x, y and f is in the range satisfying the following formula, the contrast of cross-strokes is not high and not conspicuous.

$$0 \leqq g\left(\frac{60 \cdot x \cdot f}{100 \cdot y}\right) \leqq 0.2 \quad \text{F(1)}$$

or $$0.8 \leqq g\left(\frac{60 \cdot x \cdot f}{100 \cdot y}\right) < 1 \quad \text{F(2)}$$

(in the formula, g(a)=a−[a], [a] indicates a maximum integer which does not exceed a.)

When the electrodes are disposed in a plane, the distance x between the end of the electrodes is the distance of a line parallel to the plane. When the electrodes are disposed on a curved surface, the distance x is a distance along the curved line.

In the method of electrolytic treatment, a suitable condition can be set by changing the distance between the ends of the feeding electrodes and/or the travelling speed of the material and/or the power source frequency. Therefore, cross-strokes can be hardly visible and a uniformly roughened surface can be obtained in various travelling speeds by setting a suitable difference between the electrodes in the case of deciding a frequency of the power source, and by setting a suitable frequency in the range of not affecting adversely a electrolytic treatment in the case of deciding a distance between the electrodes.

In the method of electrolytic treatment of the second aspect of the invention, the method to supply synchronized alternating currents to each electrolytic treatment baths is not particularly limited. For example, it is conducted by supplying electric current to all the electrolytic baths by only one power source or providing power sources to supply an electric current to an electrolytic treatment bath respectively and synchronizing the currents supplied by the sources by a frequency generator and setting phase differences of each source respectively.

In the method for electrolytic treatment of the second aspect of the invention, conditions for roughening in all electrolytic baths become to be equal by synchronizing alternating currents supplied to the electrodes in the electrolytic baths.

As an electrolytic solution containing metal ion of the invention, there are a hydrochloric acid solution and a nitric acid solution.

A material to be treated in accordance with the invention is suitably determined according to the object. For example, in case of a support for a presensitized plate, an aluminum web, aluminum alloy web and composite metal plate are utilized.

In FIG. 1 the numeral 1 indicates an electrolytic treatment bath and rectangular electrodes 2 and 3 are provided in the electrolytic treatment bath 1. An electrolytic solution supplying tube 4 is connected to one end of the bottom of the electrolytic treatment bath 1, and an electrolytic solution discharging tube 5 is connected to another end of the bottom. The electrolytic solution supplying tube 4 and the electrolytic solution discharging tube 5 are connected to a stock tank 6 storing an electrolytic solution 8. A pump 7 is provided at a part near the storage tank 6 of the electrolytic solution feeding tube 4 and the electrolytic solution 8 is fed to the electrolytic treatment bath 1 from the storage tank 6 by the pump 7.

The above mentioned electrodes 2 and 3 are connected to the power source 9. Besides, pass rollers 10, . . . ,10 are disposed in and out of the electrolytic treatment bath 1, and a travelling path of an aluminum web 11, as a material to be treated, is constructed thereby.

A method for electrolytic treatment of an aluminum web by using the above mentioned apparatus is explained as follows.

The distance (x) between the leading ends in a travelling direction of the aluminum web 11 of the electrodes 2 and 3, a travelling speed (y) being a conveyance speed of the aluminum web 11 and a line frequency (f) of the power source 9 are set so as to satisfy the following formula.

$$0 \leqq g\left(\frac{60 \cdot x \cdot f}{100 \cdot y}\right) \leqq 0.2 \quad \text{F(1)}$$

or $$0.8 \leqq g\left(\frac{60 \cdot x \cdot f}{100 \cdot y}\right) < 1 \quad \text{F(2)}$$

Then, the aluminum web 11 is passed over the pass rollers 10, . . . ,10 and the pass rollers 10, . . . ,10 rotate to feed the aluminum web 11. The power source 9 is switched on to feed electric currents to the electrodes 2 and 3, and then, an electrolytic treatment of an exposed surface of the aluminum web 11 is conducted.

Figure 2:
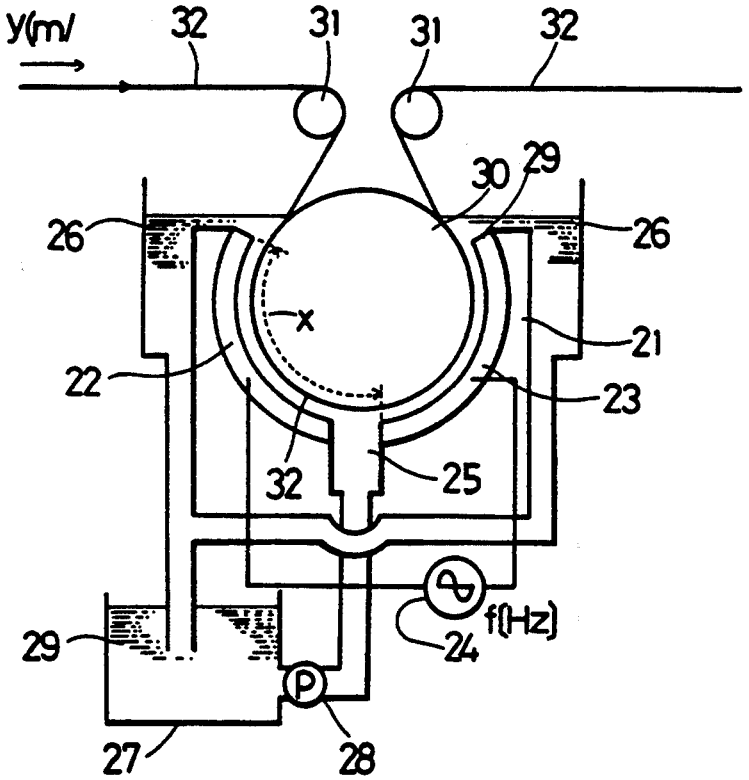
FIG. 2 is a schematic side view illustrating an apparatus to be used for another embodiment of the method for electrolytic treatment of the first aspect of the invention.

FIG. 2 is a schematic side view illustrating an apparatus for electrolytic treatment used for another embodiment of the method for electrolytic treatment of the invention.

In FIG. 2, the numeral 21 indicates a circular arc shaped electrolytic treatment bath of which an inner radius is larger than that of a drum roll, and circular arc shaped electrodes 22 and 23 are provided on the inside surface of the electrolytic treatment bath 21. The electrodes 22 and 23 are connected to a power source 24. An electrolytic solution feeding inlet 25 is provided at the center of the bottom of the electrolytic treatment bath 21, and electrolytic solution discharging outlets 26,26 are provided at both portions of an upper part thereof, and the inlet 25 and the outlets 26,26 are connected to a storage tank 27. A pump 28 is provided between the electrolytic solution feeding inlet 25 and the storage tank 27, and electrolytic solution 29 in the stock tank 27 is fed to the electrolytic treatment bath 21 by the pump 29. Besides, a drum roll 30 having a circumference of a concentric circle with the electrodes 22 and 23 is rotatably provided almost totally immersed in the electrolytic solution 29 at a slight interval from the electrodes 22 and 23 in the electrolytic treatment bath 21, and pass rollers 31 and 31 are provided above the drum roll 30. A travelling path of the aluminum web 32 is constructed by the drum roll 30 and the pass rollers 31.

A method for electrolytic treatment of an aluminum web by the above mentioned apparatus is explained as follows.

The distance (x) between leading ends on travelling direction of the aluminum web 32 of the electrodes 22 and 23, a travelling speed (y) being a conveyance speed of the aluminum web 32 and a line frequency (f) of a power source 24 are set to prescribed values similar to the above mentioned example. Then, the aluminum web 32 is adhered to the drum roll 30, and the pass rollers 31 and 31 and the drum roll 32 rotates to convey the aluminum web 32. The power source 24 is switched on supplying electric current to the electrodes 22,23, and then, an electrolytic treatment of an exposed surface of the aluminum web 32 is conducted.

EXAMPLES

Example 1

An electrolytic treatment of JIS 1050 aluminum web as a material to be treated was conducted by using the apparatus for an electrolytic treatment shown in FIG. 1. As the electrolytic solution, an aluminum nitrate solution was used at 55 C. containing 20 g/l of a nitrate acid, and 10 g/l of an aluminum ion.

The distance x between the leading ends of the electrodes is set to be 190 cm, the travelling speed y is set to be 130 m/min. and the line frequency f is set to be 40 Hz. In this condition, a value of g(a) is 0.07 ($g(a)=60\times190\times40/100\times130$), which is smaller than 0.2. Therefore, the above mentioned conditions satisfy Formula 1.

The surface of the aluminum web treated under the above mentioned electrolytic condition was evaluated by visual observation, but cross-strokes were not so conspicuous.

COMPARATIVE EXAMPLE 1

An electrolytic treatment was conducted by using the same apparatus as Example 1 under the same conditions as Example 1, except that the distance x between the leading ends of the electrodes is set to be 220 cm. In the conditions, g(a) value is 0.61 ($60\times220\times40/100\times130$), which is larger than 0.2 and smaller than 0.8, and therefore, the above mentioned conditions do not satisfy Formula 1 and 2.

The surface of the aluminum web treated under the above mentioned electrolytic condition was evaluated by visual observation, and cross-strokes of 54.2 mm pitch were clearly observed.

Figure 3:
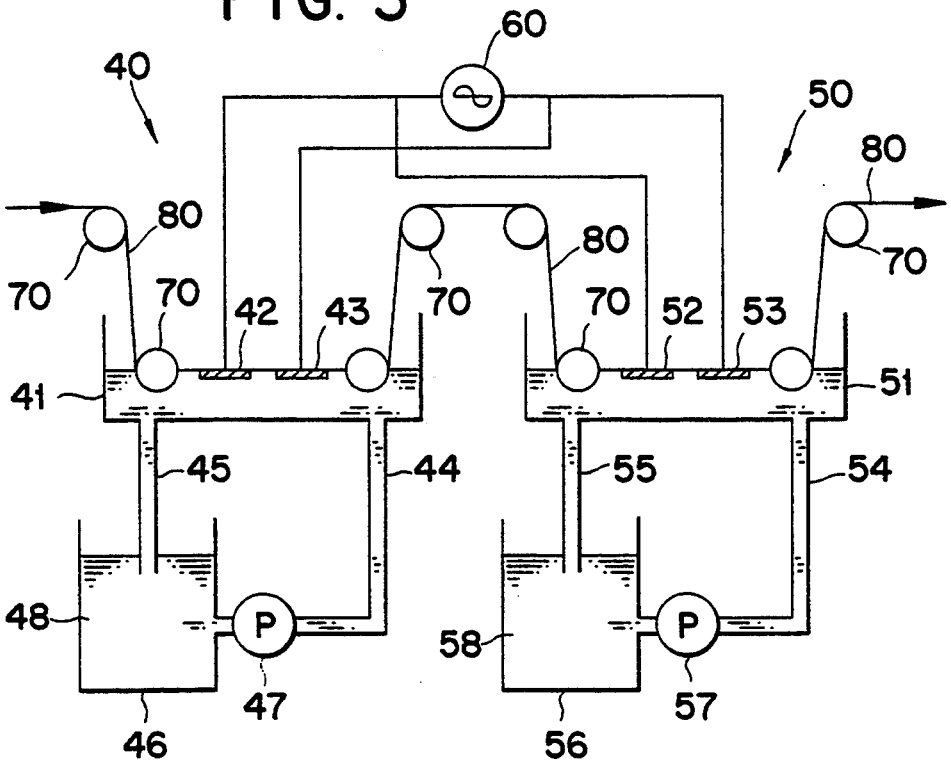
FIG. 3 is a schematic side view illustrating an apparatus to be used for an embodiment of the method for electrolytic treatment of the second aspect of the invention.

In FIG. 3, the numeral 40 indicates a pre-stage electrolytic treatment part to conduct an electrolytic treatment first, the numeral 50 indicates a post-stage electrolytic treatment part to conduct an electrolytic treatment next and the pre-stage and post-stage electrolytic treatment parts have a similar construction to each other. An electrolytic treatment bath 41 to conduct an electrolytic treatment is provided in the pre-stage electrolytic treatment part and rectangular electrodes 12 and 13 are provided in the electrolytic treatment bath 41. An electrolytic solution feeding tube 44 is connected with one end of the bottom of the electrolytic treatment bath 41 and an electrolytic solution discharging tube 45 is connected to another end of the bottom. The electrolytic solution feeding tube 44 and electrolytic solution discharging tube are connected to a storage tank 46 storing an electrolytic solution. A pump 47 is provided at the electrolytic solution feeding tube 44, and the electrolytic solution 48 is fed to the electrolytic treatment bath 41 from the storage tank 46 by the pump 47. In the post-stage electrolytic treatment part 50, an electrolytic treatment bath 51, electrodes 52 and 53, an electrolytic solution feeding tube 54, an electrolytic solution discharging tube 55, a storage tank 56, a pump 57 and an electrolytic solution 58 are provided similar to the pre-stage electrolytic treatment part 40.

The above mentioned electrodes 42 and 43 and electrodes 52 and 53 are respectively connected to the electric source 60. Besides, pass rolls 70, . . . ,70 are disposed in and out of the electrolytic treatment baths 41 and 51 and a travelling path of an aluminum web 80 as a material to be treated is constructed thereby.

A method for electrolytic treatment of an aluminum web by the above mentioned apparatus is explained as follows.

First, the aluminum web 80 is passed over the pass rollers 70, . . . ,70, and the pass rollers 70, . . . ,70 rotate to convey the aluminum web 80. The power source 60 is switched on to supply synchronized electric currents to the electrodes 42,43,52 and 53, and then, an electrolytic treatment of an exposed surface of the aluminum web 80 is conducted.

Figure 4:
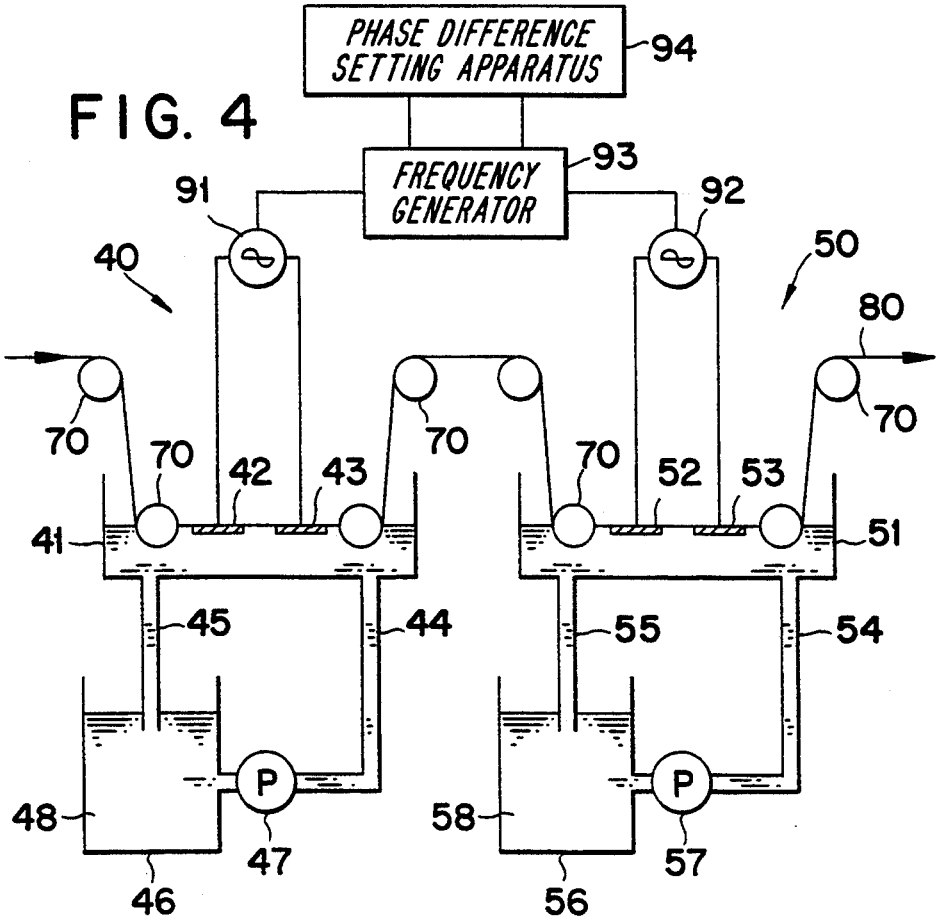
FIG. 4 is a schematic side view illustrating an apparatus to be used for another embodiment of the method for electrolytic treatment of the second aspect of the invention.

FIG. 4 is a schematic side view illustrating an apparatus for electrolytic treatment to be used for another embodiment of the method for electrolytic treatment of the second aspect of the invention.

In the apparatus for electrolytic treatment shown in FIG. 4, electrodes 42 and 43 are connected to the pre-stage side electric source 91, and electrodes 52 and 53 are connected to the post-stage power source 92. The pre-stage power source 91 and the post-stage side power sources 92 are connected to a frequency generator 93, and the frequency generator 93 is connected to a phase difference setting apparatus 94. The pre-stage electrolytic treatment part 40, post-stage electrolytic treatment part 50 and a pass roller 70 are constructed similar to the example shown in FIG. 3.

In an electrolytic treatment by the apparatus shown in FIG. 4, a current to be supplied from the power source 91 is synchronized by the frequency generator 93 and the synchronized current is fed to the electrodes 42,43,52 and 53. The other movements are similar to the example shown in FIG. 3.

Example 2

An electrolytic treatment of JIS 1050 aluminum web as a material to be treated was conducted by using the apparatus shown in FIG. 3. As an electrolytic solution, an aluminum nitrate solution at 55 °C. containing 20 g/l of a nitric acid and 10 g/l of an aluminum ion was used. Line frequency of the pre-stage power source and the post-stage power source was set at 40 Hz by the frequency generator. Travelling speed was set at 130 m/min.

The electrolytic treatment of the aluminum web was conducted under the above condition, and the surface of the aluminum web is visually observed. As a result, it is observed that cross-strokes generated at a pitch of 5.42 cm, and the level of conspicuousness of the cross-strokes are medium and is uniform irrespective of the position in a longitudinal direction of the aluminum web.

COMPARATIVE EXAMPLE 2

Frequency of the pre-stage power source is set to be 40 Hz, and line frequency of the post-stage power source is set to be 40.4 Hz without using a frequency generator. Other construction and condition were set to be the same as Example 2.

The electrolytic treatment of the aluminum web was conducted under the above condition and the surface of the aluminum web is visually observed. As a result, it is observed that cross-strokes generated at a pitch of 5.42 cm and the level of conspicuousness of the cross stroke repeated between good level and bad level at periodic intervals of 325 m.

We claim:

1. A method for electrolytic treatment comprising forming electrochemically a rough surface on a material to be treated by supplying alternating current between the material to be treated and electrodes in an electrolytic solution containing metal ion, when y[m/min.] indicates a travelling speed of the material, f[Hz] indicates an line frequency of power source and x[cm] indicates a distance between leading ends of the electrodes, said electrolytic roughening treatment being conducted by selecting x, y and f so as to satisfy the following formula;

$$0 \leqq g\left(\frac{60 \cdot x \cdot f}{100 \cdot z}\right) \leqq 0.2$$

-continued or $$0.8 \leqq g\left(\frac{60 \cdot x \cdot f}{100 \cdot z}\right) < 1$$

(in the formula, g(a)=a−[a], here [a] indicates a maximum integer which does not exceed a).

2. The method in described in claim 1 wherein only one power source supplies the alternating currents to all the electrolytic treatment baths.

3. The method in described in claim 1 wherein power sources capable of setting phase differentiation are provided corresponding to the electrolytic treatment baths, and the power sources supplying the alternating currents to the electrolytic treatment baths are controlled by a frequency generator.

4. A method for electrolytic treatment comprising forming an electrochemically rough surface on a material treated by supplying alternating current between said material and electrodes in an electrolytic solution containing metal ions, said electrolytic treatment using two or more electrolytic treatment baths, each electrolytic treatment bath halving two electrodes wherein the alternating current supplied to each electrolytic treatment bath is synchronized.

* * * * *